United States Patent [19]

Hartmann

[11] Patent Number: 4,516,490

[45] Date of Patent: May 14, 1985

[54] PRESS DRAINAGE

[75] Inventor: Eduard Hartmann, Schneisingen, Switzerland

[73] Assignee: Bucher-Guyer AG, Niederweningen, Switzerland

[21] Appl. No.: 549,925

[22] Filed: Nov. 8, 1983

[30] Foreign Application Priority Data

Dec. 21, 1982 [CH] Switzerland ..... 7442/82

[51] Int. Cl.[3] ..... B30B 9/06

[52] U.S. Cl. ..... 100/107; 100/126; 100/211

[58] Field of Search ..... 100/104, 107, 108, 109, 100/126, 211

[56] References Cited

U.S. PATENT DOCUMENTS

| | | | |
|---|---|---|---|
| 2,852,141 | 9/1958 | Landon | 100/126 |
| 3,103,164 | 9/1963 | Willmes | 100/122 X |
| 3,207,064 | 9/1965 | Hauser-Bucher | 100/107 |
| 4,024,810 | 5/1977 | Braun | 100/107 X |

FOREIGN PATENT DOCUMENTS

| | | | |
|---|---|---|---|
| 2945254 | 5/1981 | Fed. Rep. of Germany | 100/104 |
| 139320 | 2/1953 | Sweden | 100/107 |

*Primary Examiner*—Peter Feldman
*Attorney, Agent, or Firm*—Ernest F. Marmorek

[57] ABSTRACT

A press for extracting fluid from fluid-containing matter so as to separate the fluid from the remaining matter, particularly for dejuicing of agricultural products, primarily fruit, includes a rotatably supported container, and at least one flexible membrane which can be actuated by exerting pressure thereon. The membrane is disposed in the container, and subdivides the container so as to define a pressure chamber and a press space therein. At least one wall surrounds the press space, and the pressure chamber has an inlet conduit and an outlet conduit for a pressure medium. Flexible drainage devices are located at least partly on the wall, and extend into the press space.

19 Claims, 8 Drawing Figures

PRESS DRAINAGE

BACKGROUND OF THE INVENTION

Presses for extracting fluid from fluid-containing matter so as to separate the fluid from the remaining matter, particularly for dejuicing of agricultural products, primarily fruit, are known. Such presses include a rotatably supported press container, and a flexible membrane actuated by pressure means subdividing the container so as to define a pressure chamber and a press space therein, and wherein the pressure chamber is provided with an inlet conduit and an outlet conduit for a pressure medium, and the press space is provided with a drainage mechanism.

Devices of this kind are known under the designation "Roto-Pressmatic" manufactured by the firm Bucher. In such presses the drainage mechanism consists of several drainage members extending along the wall of the container within the press space parallel to the axis of the container. Each drainage member has a roof-like shape extending into the press space, and its wing surfaces have perforations, through which the juice is drained off.

So-called open systems are also known, in which the container has perforations in the wall within the region of the press space, so that the juice streams first into a receiving vat disposed below the container.

It has been shown that the pressing of grape pulp by such systems requires a processing time of relatively long duration, which is partly due to an unsatisfactory dejuicing using known systems or devices.

No significant improvement of the output of the press of this type has been obtained by means of various tests using, for example, a larger number of throughgoing openings in the drainage members, or in the wall of open systems in the press space, or increasing the number of drainage members, or increasing their constructional size.

Neither has it been possible to increase the output by covering the drainage mechanism with a textile filter cloth. Experiments in which the pressure-applying process was enhanced by creating a vacuum in the press space, although resulting in a respectable increase of the output, have nevertheless reduced the profitability of the pressing process, due to the resulting higher operating costs.

All of the above-mentioned application possibilities did not contribute sufficiently to the known pressing process, in spite of the considerable additional expense entailed.

These tests have led to the assumption that increased amounts of accumulated juice arise between thickened layers of the mash during and after the filling of the container. Juice bubbles arising in this manner cannot be extracted during the pressing process, as the mash surrounding these bubbles is compressed even further.

This state of affairs has led to the consideration that in presses having a closed container system, namely when using drainage members, pre-dejuicing should only be accomplished after filling of the press has been completed. In such a case the solid ingredients of the mash would settle near the top, so that such large juice bubbles could not be formed in the mash. This state of affairs could be obtained without any trouble, but during the subsequent opening of the drainage mechanism the solid ingredients of the mash were attracted by the suction of the liquid, and in fact coated the liquid in such a manner that the drainage was worsened, and juice bubbles arose anew in the mash.

SUMMARY OF THE INVENTION

The above-described state of affairs has led to a rethinking of the process. Consequently it is an object of the invention to devise a drainage mechanism or device in presses of the aforedescribed type, in which the aforecited disadvantages are avoided, and which can be manufactured and operated economically, and where, in particular, juice bubbles and other wet zones in the mash can be reached and dejuiced.

This object is attained, according to the invention, by the wall forming the press space being provided, at least in part, with drainage means extending into the press space. Other objects of the invention will in part be obvious from the following description, and will in part be contained in the claims.

BRIEF DESCRIPTION OF THE DRAWING

For a fuller understanding of the nature and objects of the invention, reference should be had to the following detailed description, taken in connection with the accompanying drawing, in which.

DESCRIPTION OF THE PREFERRED EMBODIMENTS

Figure 1:
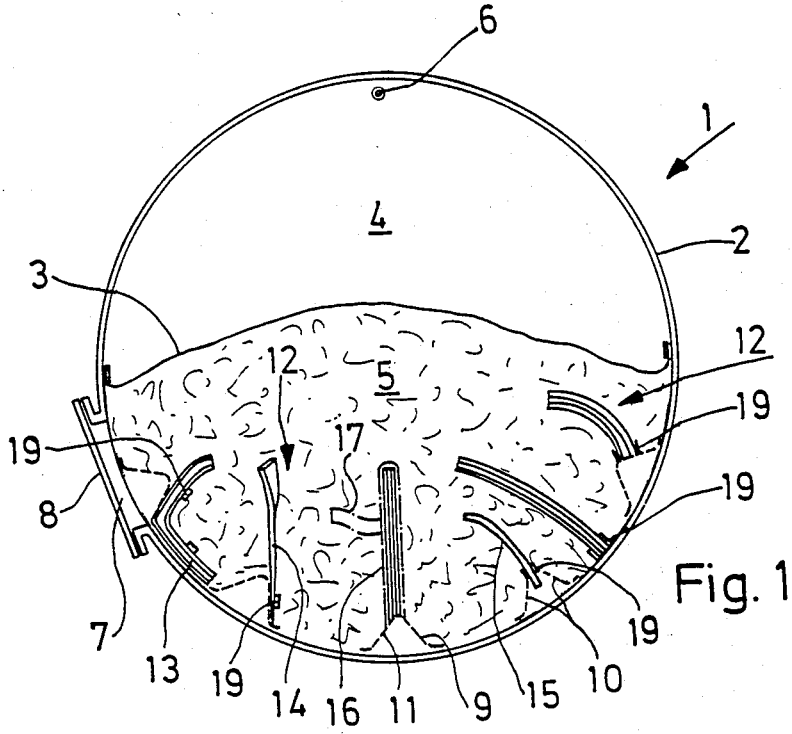
FIG. 1 is a cross-section through a closed press container, according to the invention, showing different embodiments of the drainage device, and how they are disposed in the container.

Referring now to the drawing, and in particular FIG. 1, there is shown a press 1 for dejuicing agricultural products, particularly grapes or similar fruits, and including a longitudinal and cylindrical press container 2, which may be driven around a horizontal axle, and which is subdivided by a flexible membrane 3 disposed in an interior thereof into a pressure chamber 4 and a press space 5. The pressure chamber 4 includes an inlet and an outlet conduit 6 for a pressure medium, for example air, while the press space 7 is provided with an inlet and outlet opening 7 for the mash. The opening 7 may be closed by means of a cover 8.

The illustrated press 1 is provided with a press container 2, which, apart from the aforedescribed openings, is closed, and wherein drainage elements 9 are connected within the press space 5 to an inner wall thereof, and extend parallel to the axle of rotation. The roof-shaped or V-shaped drainage elements 9 are formed with slits 11 on their lateral wings or arms 10, through which the juice passes into the drainage elements, and streams therefrom into a (non-illustrated) juice-collection chamber disposed at the front side of the press container 2. Drainage means, for example drainage members 12, are provided to enhance the dejuicing process, and are connected to the wall of the press container within the press space 5 and/or to the drainage elements 9. The drainage members 12 penetrate deeply into the mash, and enhance the drainage of the juice, particularly from the interior of the mash to the drainage elements 9. The drainage elements 12 can, for this purpose, be implemented in a particular manner and disposed in particular arrangements.

Different cross-sections are provided in different respective embodiments of the drainage members 12. The drainage members can, for example be cylindrical and smooth, or be provided with longitudinal grooves 13, shaped as flat bars 14, or as longitudinal bars 15 extending approximately over the length of the container, and provided with grooves. The drainage members 12 are flexible, or elastic and blunt, so that they do not damage the membrane 3 when the amount of mash decreases. They partially abut the drainage elements 9, or are connected to the interior wall of the container so that they project inwardly with a free end therefrom, and can also be surrounded by a sleeve made of material which acts as a filter.

It would be possible to connect the normally free ends of at least some individual drainage members 12 to one another, so that a mutual interaction would occur during juice guidance.

The sleeve 16 can also be provided with lateral border strips 17, so that the drainage effect is improved thereby.

It is also possible for the drainage members to consist of a textile filter web, for example in the form of folded strips.

Figure 2:
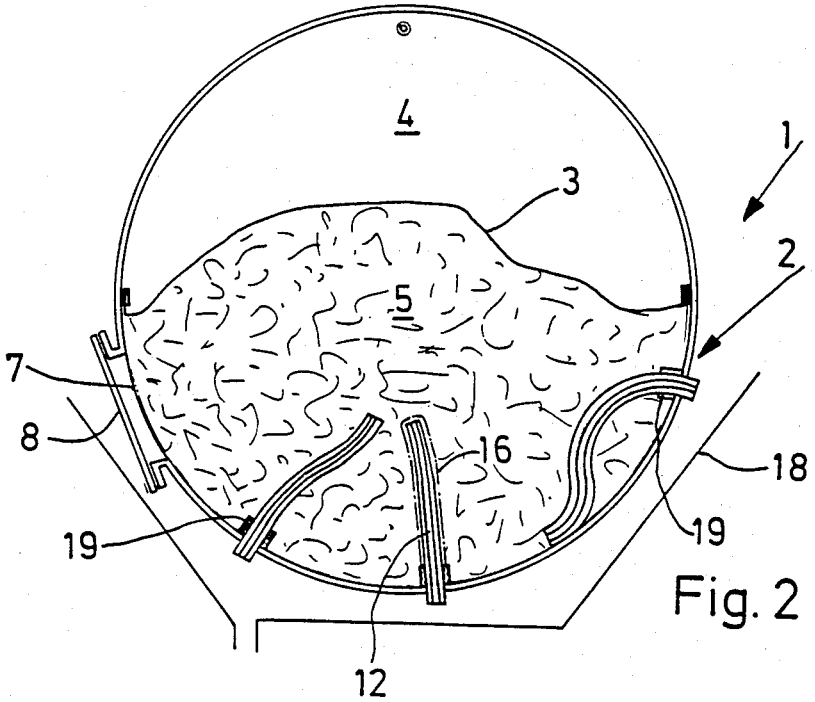
FIG. 2 is a cross-section through a press container constructed as an open system, and provided with an alternate drainage mechanism.

In FIG. 2 there are provided individual drainage elements 12 in a press 1, according to the open system, which are advantageously distributed approximately over the entire wall of the press-space container. The press container 2 is provided within the region of the press space 5 with perforations consisting of slits 11 or similar through-going openings, through which the juice can pass freely into a juice-collecting vat 18 disposed therebelow.

Figure 3:
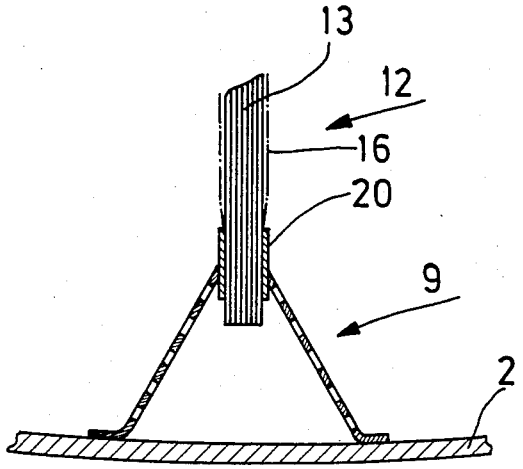
FIG. 3 is a large-scale section through the drainage mechanism.
Figure 4:
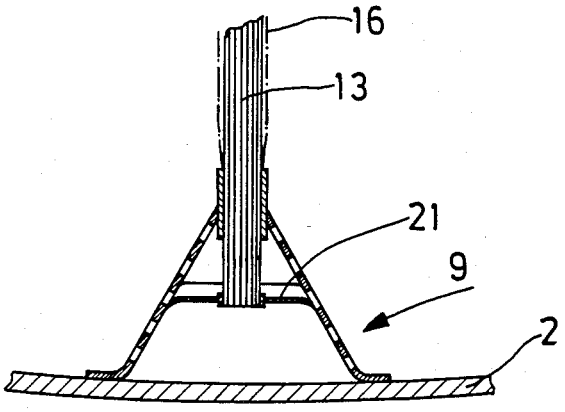
FIG. 4 is a large-scale section through an alternate embodiment of a drainage mechanism.

The drainage members 12 are anchored to holding means 19, as can be ascertained also from FIG. 1, and which are described in greater detail when referring to FIGS. 3 and 4. The drainage members 12 shown in FIGS. 1 and 2, which may be straight or curved, when unstressed, conform yieldingly to the pressure of the membrane 3 in view of their elastic deformability, so that they can be laid out arbitrarily in the mash.

Just as the walls of the press container 2, the flexible membrane or membranes 3 can also be provided with drainage members 12, which primarily open new drainage passages to the other drainage members 12, and thereby pass juice bubbles therethrough.

FIGS. 3 and 4 show holding means 19 for the drainage members 12. Thus, for example, according to FIG. 3, each drainage element 9 is provided in the region of its crest with a tube-like casing 20, to which the drainage members 12 are releasably connected. Each sleeve 16 can also be surroundingly held by means of a corresponding casing 20.

According to FIG. 4 the drainage element 9 is provided with a bar-like connecting plate 21 extending between the wings or arms 10, and the through-going opening or openings for the drainage member 12, so as to better control the forces acting on the holding means 20, or on the drainage elements 9.

Figure 5:
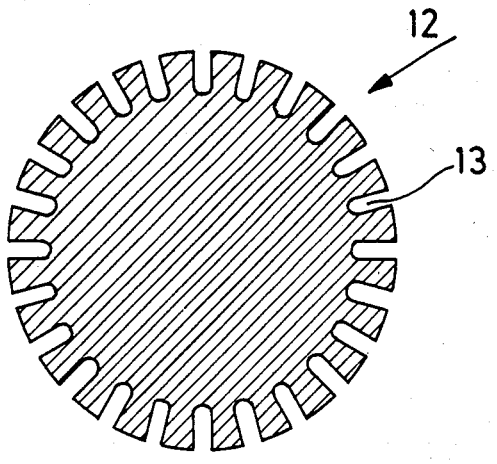
FIG. 5 is a cross-section through an individual drainage member.
Figure 6:
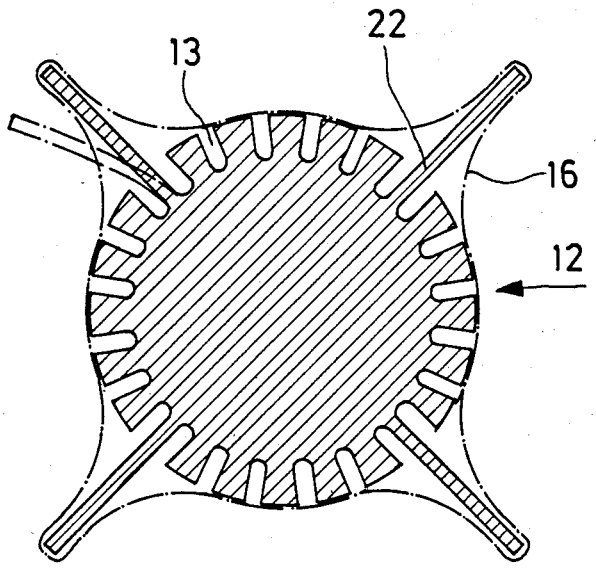
FIG. 6 is a cross-section through an alternate embodiment of a drainage member.

In FIGS. 5 and 6 there are shown cross-sections of various drainage members 12 which, due to their required elasticity, are formed from a rubber-like material, and have on their periphery longitudinal grooves 13. The width of the grooves 13 should, as far as possible, be selected to be smaller than that of the solid particles of the mash, particularly the pits of the fruits.

In FIG. 6 there is shown a particular embodiment of a drainage member 12, the cross-section of which is provided with individual flaps 22 extending from its periphery, which penetrate more deeply into the mash or pulp. This embodiment can also be surrounded with a sleeve 16, which acts as a filter.

Figure 7:
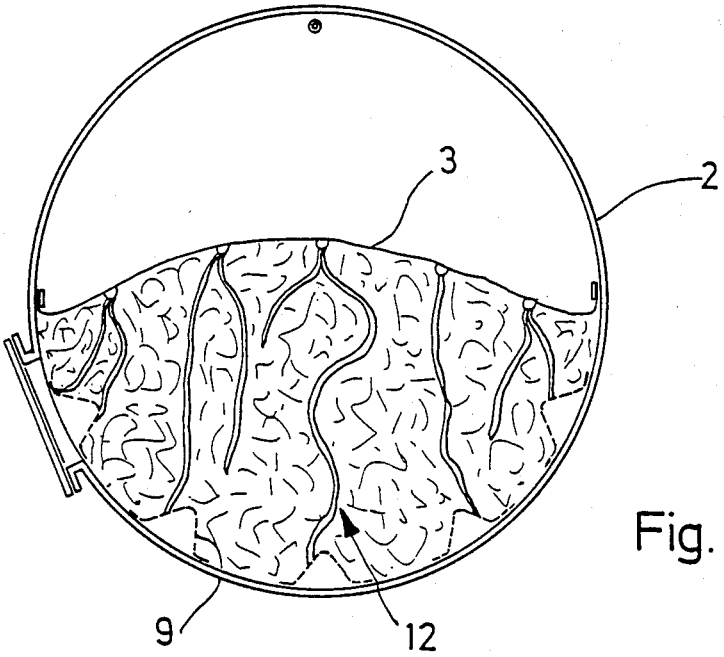
FIG. 7 is a cross-section through a press container according to FIG. 1, but having an alternate drainage mechanism.

In FIG. 7 there is shown a press of this type having a closed container and drainage elements 9, and wherein the strip-like or cord-like drainage members 12 are connected with a movable end thereof to the membrane, are distributed over the entire space of the mash or pulp in this manner, and extend in part up to the drainage elements 9.

The drainage members 12 can be connected in bundles or individually to the membrane 3. Some drainage members 12 could also have two non-free ends, for example be connected with one end thereof to the membrane 3, and with the other end thereof to the drainage arrangement, (drainage elements or wall of the container), and may even have an excessive length when the membrane 3 is withdrawn. If the drainage members 12 are formed as strips, a textile filter web could also be used, for example in the form of a narrow sleeve.

Figure 8:
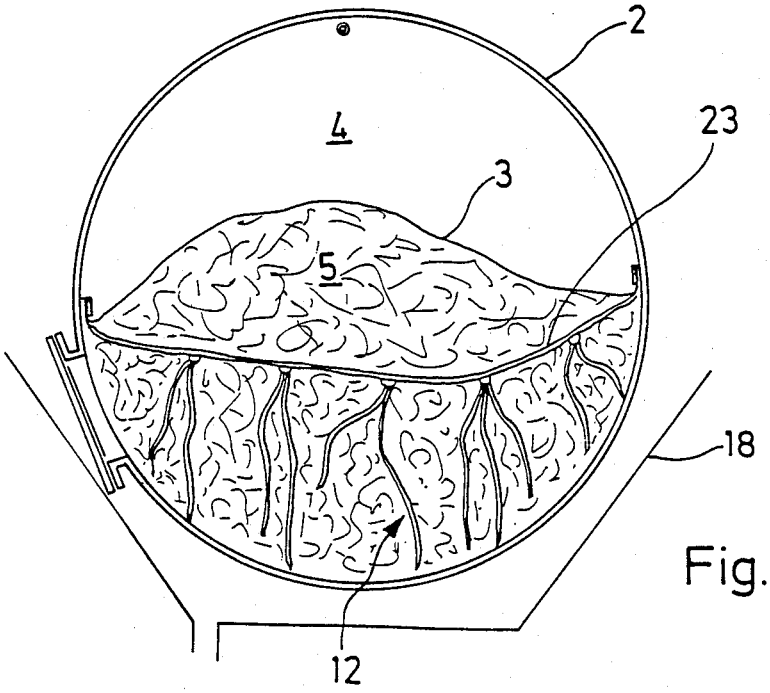
FIG. 8 is a cross-section through a press container manufactured as an open system according to FIG. 2, but having an alternate drainage mechanism.

A similar embodiment of the drainage elements 12 is shown in FIG. 8, the difference being that the drainage elements 12 are connected to transversely or longitudinally extending cords 23 within the press space 5.

The drainage members 12 do not interfere with the loosening cycles; on the contrary, the stable bodies facilitate such a process.

It is, of course, equally possible to utilize the inventive drainage members 12 instead of a press container having drainage elements 19, or instead of a perforated mantle of the container.

In such an embodiment the drainage members 12 pass through the wall of the container, and communicate with a juice-collecting vat according to FIG. 2, or they communicate with a juice-collecting chamber disposed on the press container 2 within the region of their connection, or their outlet openings may be connected to one another by means of conduits.

I wish it to be understood that I do not desire to be limited to the exact details of construction shown and described, for obvious modifications will occur to a person skilled in the art.

Having thus described the invention, what I claim as new and desire to be secured by Letters Patent is as follows:

1. A press for extracting fluid from fluid-containing matter so as to separate the fluid from the remaining matter, particularly for dejuicing of agricultural products, primarily fruit, comprising in combination a rotatably supported container, at least one flexible membrane actuatable by pressure means, disposed in said container, and subdividing said container so as to define a pressure chamber and a press space therein, at least one wall surrounding said press space, said pressure chamber having an inlet conduit and an outlet conduit for a pressure medium, and a plurality of flexible drainage means, at least some of said drainage means having free ends, at least the remaining drainage means having ends connected to said wall, said flexible drainage means extending into said press space.

2. A press as claimed in claim 1, wherein said drainage means include a plurality of longitudinal drainage members.

3. A press as claimed in claim 2, wherein the cross-section of each drainage member is round.

4. A press as claimed in claim 2, wherein the cross-section of each drainage member is oval.

5. A press as claimed in claim 2, wherein the cross-section of each drainage member is polygonal.

6. A press as claimed in claim 1, wherein said drainage means are elastically deformable.

7. A press as claimed in claim 2, wherein each drainage member has a groove extending in a longitudinal direction.

8. A press as claimed in claim 2, further comprising a filtering sleeve surrounding at least a portion of each drainage member.

9. A press as claimed in claim 18, wherein each sleeve includes at least one laterally disposed strip composed of drainage-effective material.

10. A press as claimed in claim 2, wherein each drainage member has a free end, at least some of said free ends being connected to one another.

11. A press as claimed in claim 2, and holding means which include a drainage element.

12. A press as claimed in claim 2, wherein each drainage member is shaped in the form of a string or of a band, and is connected with one end thereof to said membrane.

13. A press as claimed in claim 2, further comprising a plurality of drainage elments within said press space connected to said wall, and wherein each drainage member is connected with one end thereof to said membrane, and with the other end thereof to a corresponding drainage element.

14. A press as claimed in claim 2, wherein each drainage member is connected with one end thereof to said membrane, and with the other end thereof to said wall.

15. A press as claimed in claim 2, further comprising a plurality of cords passing through said press space, and wherein each drainage member has a string-like or band-like shape, and is connected with one end thereof to at least one of said cords.

16. A press for extracting fluid from fluid-containing matter so as to separate the fluid from the remaining matter, particularly for dejuicing of agricultural products, primarily fruit, comprising in combination a rotatably supported container, at least one flexible membrane actuatable by pressure means disposed in said container and subdividing said container so as to define a pressure chamber and a press space therein, at least one wall surrounding said press space, said pressure chamber having an inlet conduit and an outlet conduit for a pressure medium, and flexible drainage means disposed at least partly on said wall and extending into said press space, wherein said drainage means include a plurality of longitudinal drainage members, and wherein each drainage member has a plurality of grooves, and includes a plurality of flaps projecting from its periphery.

17. A press as claimed in claim 2, wherein the drainage members ae formed as longitudinal bars extending approximately over the length of the container.

18. A press as claimed in claim 2, wherein the drainage members are formed as textile filter fibers.

19. A press as claimed in claim 1, wherein the ends of said remaining drainage means connected to said wall are fixed ends, and wherein each of the remaining drainage means has an other end opposite said fixed end, and wherein the distance between the fixed end and the other end of one of the remaining drainage means is generally different from the distance between the fixed end and the other end of another of said remaining drainage means.

* * * * *